US012729419B2

(12) United States Patent
Kim

(10) Patent No.: US 12,729,419 B2
(45) Date of Patent: Sep. 8, 2026

(54) FE-BASED ALLOY AND ALLOY POWDER

(71) Applicants: KOLON INDUSTRIES, INC., Seoul (KR); ATTOMETAL TECH PTE. LTD., Singapore (SG)

(72) Inventor: Choongnyun Paul Kim, Seoul (KR)

(73) Assignees: KOLON INDUSTRIES, INC., Seoul (KR); ATTOMETAL TECH PTE. LTD., Singapore (SG)

( * ) Notice: Subject to any disclaimer, the term of this patent is extended or adjusted under 35 U.S.C. 154(b) by 454 days.

(21) Appl. No.: 18/040,649

(22) PCT Filed: Aug. 4, 2021

(86) PCT No.: PCT/KR2021/010224
§ 371 (c)(1),
(2) Date: Feb. 6, 2023

(87) PCT Pub. No.: WO2022/031000
PCT Pub. Date: Feb. 10, 2022

(65) Prior Publication Data

US 2024/0026506 A1 Jan. 25, 2024

(30) Foreign Application Priority Data

Aug. 7, 2020 (KR) ..... 10-2020-0099078
Aug. 3, 2021 (KR) ..... 10-2021-0102000

(51) Int. Cl.
*C22C 38/22* (2006.01)
*C22C 38/26* (2006.01)
(Continued)

(52) U.S. Cl.
CPC ..... *C22C 38/22* (2013.01); *C22C 38/26* (2013.01); *C22C 38/32* (2013.01); *C23C 4/067* (2016.01); *C23C 4/134* (2016.01)

(58) Field of Classification Search
CPC ..... C22C 38/22; C22C 38/26; C22C 38/32; C22C 38/36; C22C 33/0285; C22C 45/02; B33Y 70/00; C23C 4/067
See application file for complete search history.

(56) References Cited

U.S. PATENT DOCUMENTS 11,326,239 B2 * 5/2022 Cao ..... B22F 1/00
11,932,944 B2 * 3/2024 Cho ..... C23C 24/04
(Continued)

FOREIGN PATENT DOCUMENTS

CN 101033530 A 9/2007
CN 102859024 A 1/2013
(Continued)

OTHER PUBLICATIONS

WO 2021091074 A1 machine translation (Year: 2021).*
(Continued)

*Primary Examiner* — Tima M. McGuthry-Banks
(74) *Attorney, Agent, or Firm* — Harvest IP Law, LLP

(57) ABSTRACT

Fe-based alloy and alloy powder obtainable therefrom according to one aspect of the present invention comprise iron (Fe), chromium (Cr), molybdenum (Mo), and niobium (Nb), and, may contain, relative to 100 wt % of iron, 17.22-58.23 wt % chromium, 1.2-26.1 wt % molybdenum, and 0.12-6.22 wt % niobium.

5 Claims, 4 Drawing Sheets

(51) Int. Cl.

| | |
|---|---|
| ***C22C 38/32*** | (2006.01) |
| ***C23C 4/067*** | (2016.01) |
| ***C23C 4/134*** | (2016.01) |

(56) References Cited

U.S. PATENT DOCUMENTS

| | | | |
|---|---|---|---|
| 2013/0052361 | A1 | 2/2013 | Croopnick |
| 2020/0109465 | A1 | 4/2020 | Cao |
| 2023/0052361 | A1 | 2/2023 | Skog et al. |

FOREIGN PATENT DOCUMENTS

| | | | | |
|---|---|---|---|---|
| CN | 103060737 | A | 4/2013 | |
| CN | 110799663 | A | 2/2020 | |
| GB | 1039809 | | 8/1966 | |
| JP | S55145150 | A | 11/1980 | |
| JP | H07316771 | A | 12/1995 | |
| JP | 08325675 | | 12/1996 | |
| JP | 2001303218 | A | 10/2001 | |
| JP | 2008-539327 | A | 11/2008 | |
| JP | 2009035786 | A | 2/2009 | |
| JP | 2018503739 | A | 2/2018 | |
| KR | 20000039464 | A | 7/2000 | |
| KR | 10-0723167 | B1 | 5/2007 | |
| KR | 10-2012-0139821 | A | 12/2012 | |
| KR | 20150105284 | A | 9/2015 | |
| KR | 10-2020-0021090 | A | 2/2020 | |
| WO | WO-2011116350 | A1 * | 9/2011 | ..... B22F 1/0003 |
| WO | WO-2016099390 | A1 * | 6/2016 | ..... C22C 38/32 |
| WO | WO-2021091074 | A1 * | 5/2021 | ..... C23C 4/10 |
| WO | WO-2021145710 | A1 * | 7/2021 | ..... C23C 24/08 |

OTHER PUBLICATIONS

He W, Chen J, Deng Y, Yan Z. Isothermal Oxidation Kinetics of Iron Powders Under Vapor Atmosphere. Metals. 15(5):553. https://doi.org/10.3390/met15050553 (Year: 2025).*

* cited by examiner

[Fig. 1(a)]
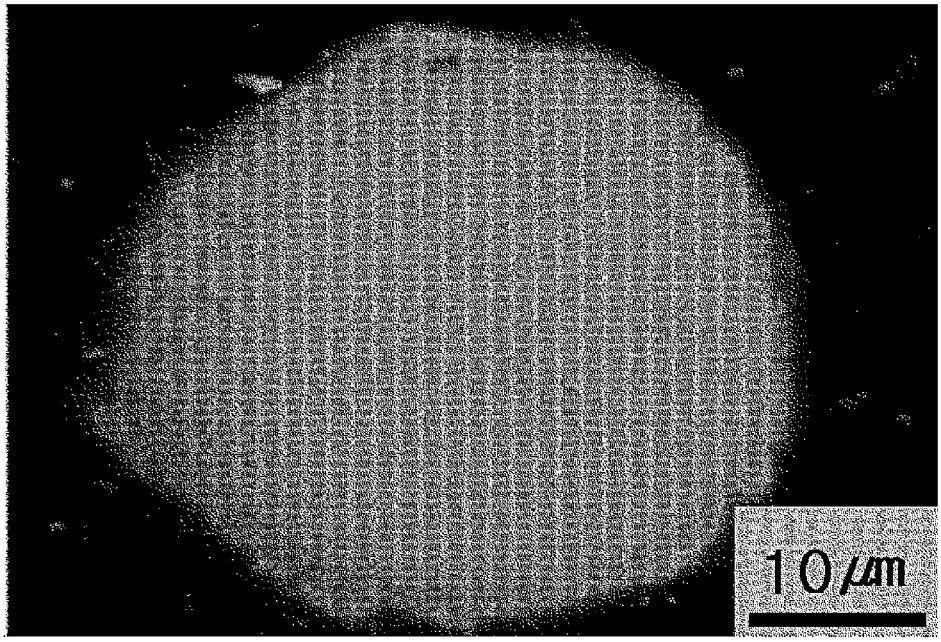
[Fig. 1(b)]
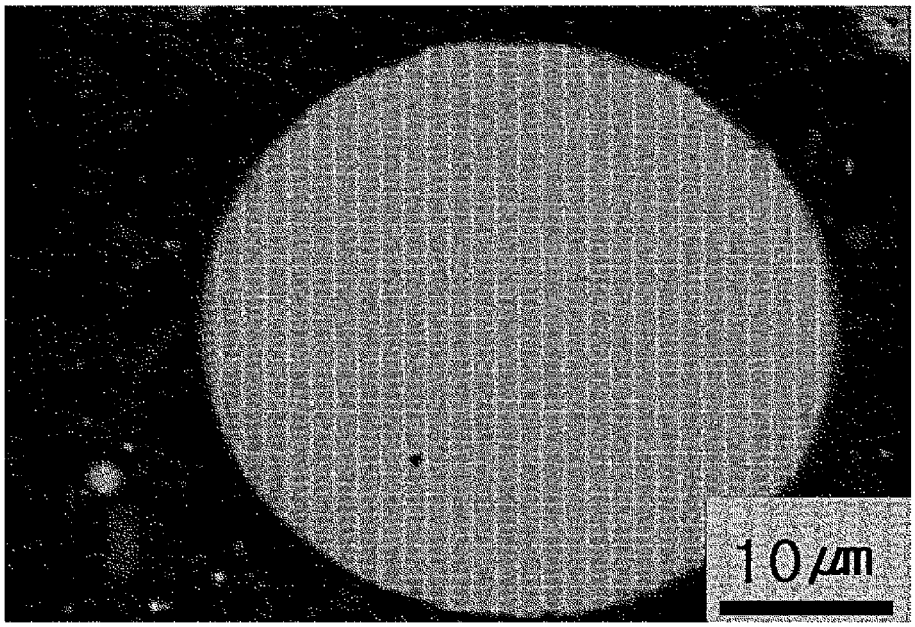

[Fig. 2(a)]
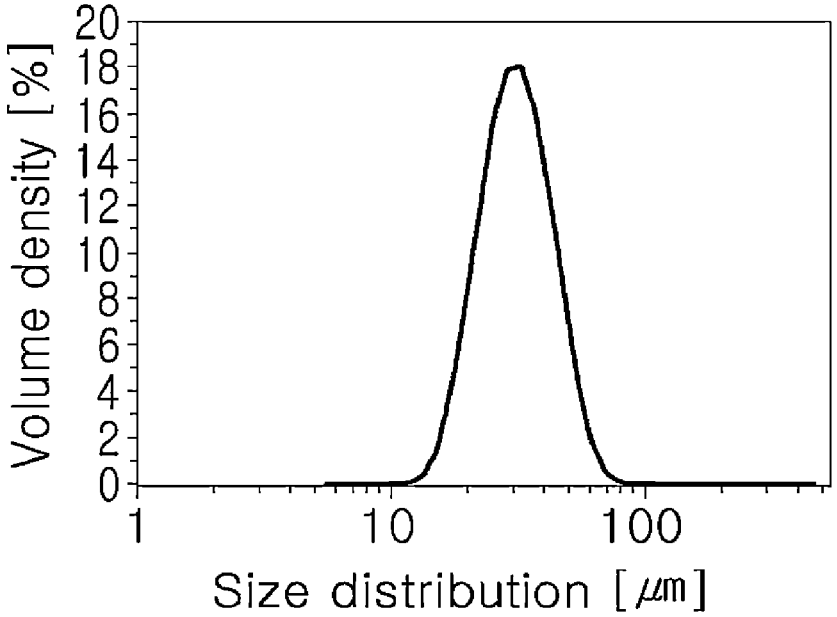
[Fig. 2(b)]
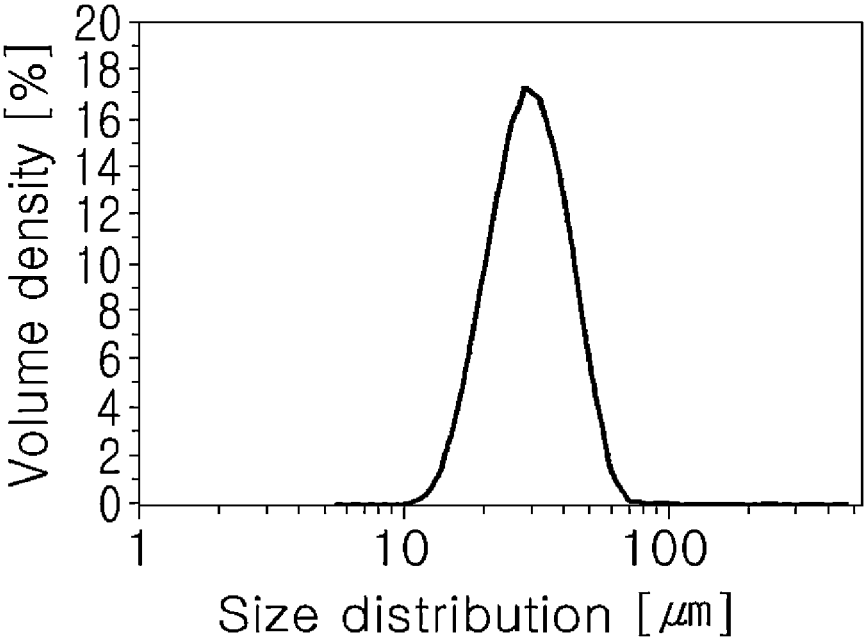

[Fig. 3(a)]
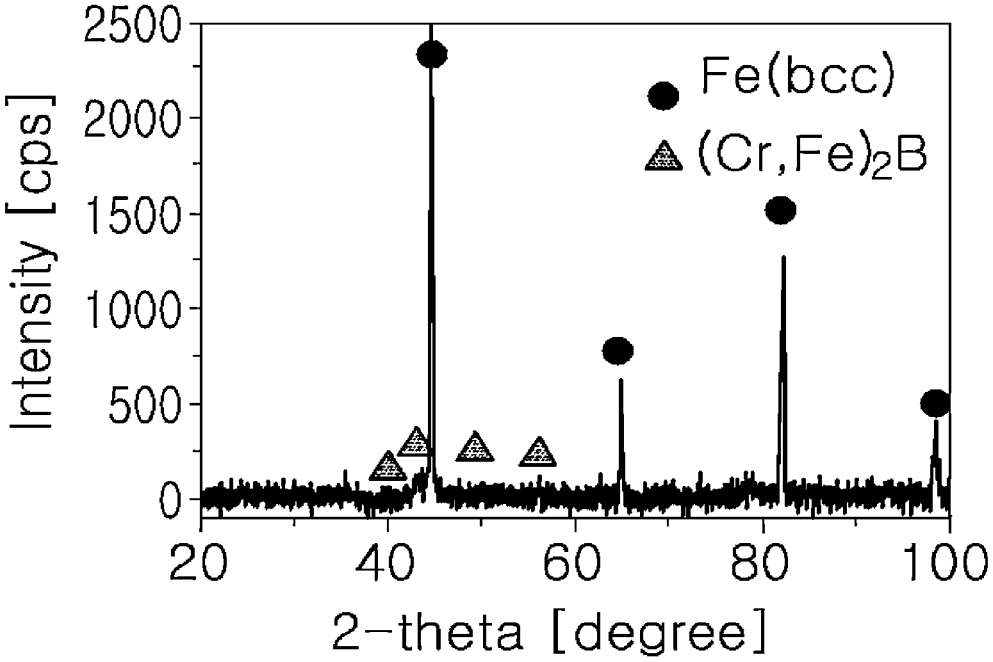
[Fig. 3(b)]
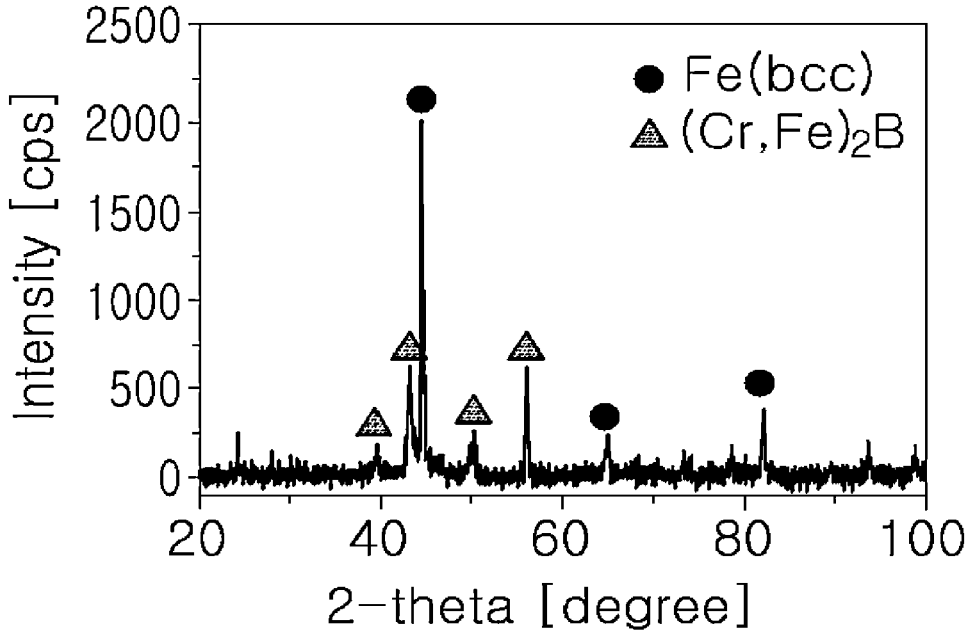

[Fig. 4(a)]
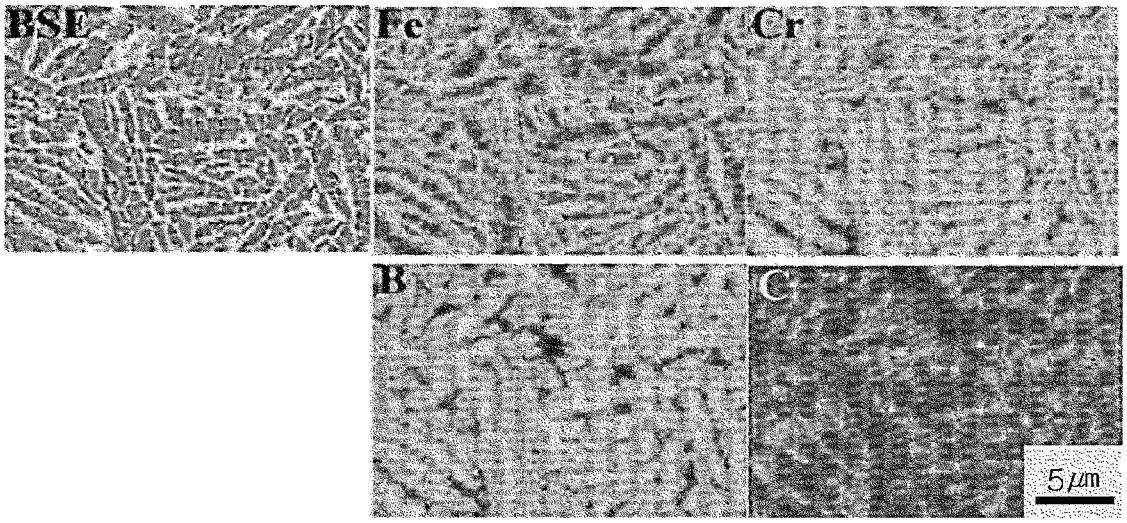
[Fig. 4(b)]
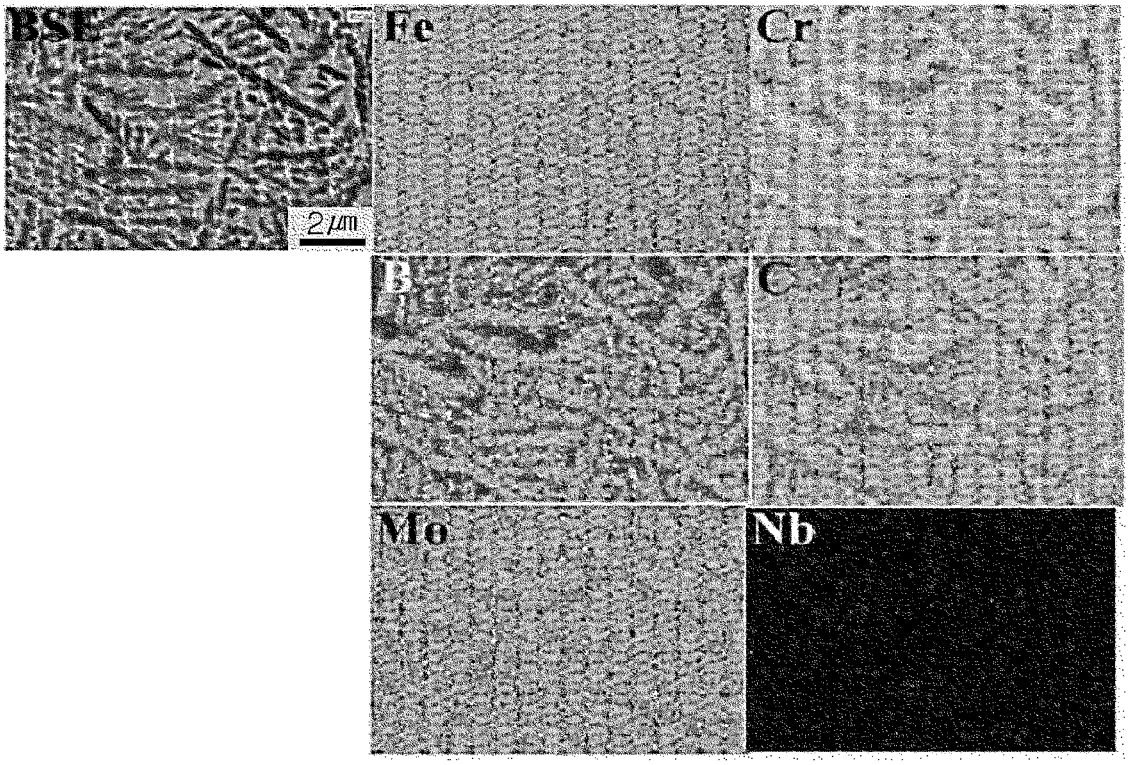

FE-BASED ALLOY AND ALLOY POWDER

CROSS REFERENCE TO RELATED APPLICATION(S)

This application is a National Stage of International Application No. PCT/KR2021/010224 filed Aug. 4, 2021, claiming priority based on Korean Patent Application No. 10-2020-0099078 filed Aug. 7, 2020 and Korean Patent Application No. 10-2021-0102000 filed Aug. 3, 2021, the disclosures of which are incorporated herein by reference in their entireties.

JOINT RESEARCH AGREEMENT

The presently claimed invention was made by or on behalf of the below-listed parties to a joint research agreement. The joint research agreement was in effect on or before the date the claimed invention was made, and the claimed invention was part of the joint research agreement and made as a result of activities undertaken within the scope of the joint research agreement. The parties to the joint research agreement are Kolon Industries, Inc. and Attometal Tech Pte. Ltd.

TECHNICAL FIELD

The present disclosure relates to an iron-based alloy and alloy powder, and more particularly, to an alloy having excellent glass forming ability and having excellent wear and corrosion resistance to be used for various purposes and an alloy powder prepared from the alloy.

BACKGROUND ART

An amorphous alloy is an alloy in which metal atoms included in the alloy have a random and chaotic structure rather than a crystalline structure. Amorphous alloys have excellent chemical, electrical, and mechanical properties, and thus have been studied for various purposes, but there are not many cases in which amorphous alloys have been commercialized to date, due to difficulty in forming and manufacturing thereof, as well as high costs.

Two conditions should be satisfied to manufacture an amorphous alloy. An alloy composition having high glass forming ability is required, and a rapid cooling rate of a molten alloy is required. For example, a molten alloying material is required to be rapidly cooled and, even when rapid cooling is performed, an amorphous phase may not be formed at low glass forming ability of a composition of the alloy material.

In particular, when a product such as a coated body or a formed body is manufactured using alloy powder prepared from an amorphous alloy, a sufficient cooling rate is often not obtained in a process in which the alloy powder is molten and then cooled. For example, crystallization, rather than amorphization, mainly occurs, so that a ratio of the amorphous phase in the product may be rapidly reduced to cause difficulty in manufacturing an applied product utilizing characteristics of the amorphous alloy material.

Due to such issues, when a formed body is manufactured or a coating layer is formed using an amorphous alloy, a ratio of an amorphous phase may be reduced and desired physical properties of a product may not be obtained or density may not be excellent, so that corrosion resistance may be reduced and permeation of foreign materials may easily occur.

Accordingly, there is a need for research into an alloy, which may allow a ratio of an amorphous phase to be maintained to be high and may improve microstructural and mechanical properties, and a method of applying the alloy.

PRIOR ART DOCUMENTS (Patent Document) Korean Patent Registration No. 10-0723167

SUMMARY OF INVENTION

Technical Problem

An aspect of the present disclosure is to develop an alloy, which may obtain a high amorphous ratio when the alloy is used for various uses and purposes due to excellent glass forming ability thereof, and to provide alloy powder which may be prepared from the alloy and has mechanical and chemical properties, for example, oxidation resistance, wear resistance, and corrosion resistance.

In addition, an aspect of the present disclosure is to provide an alloy powder in which a ratio of an oxide included in an alloy coating layer is obtained to be low because oxidation is insufficiently performed during utilization of the alloy powder due to excellent oxidation stability.

Solution to Problem

According to an aspect of the present disclosure, an iron-based alloy includes:

per 100 parts by weight of iron (Fe),
17.22 to 58.23 parts by weight of chromium (Cr);
1.20 to 26.10 parts by weight of molybdenum (Mo); and
0.12 to 6.22 parts by weight of niobium (Nb).

According to another aspect of the present disclosure, an iron-based alloy powder includes:

per 100 parts by weight of iron (Fe),
17.22 to 58.23 parts by weight of chromium (Cr);
1.20 to 26.10 parts by weight of molybdenum (Mo);
0.12 to 6.22 parts by weight of niobium (Nb); and
an amorphous phase.

Advantageous Effects of Invention

According to an aspect of the present disclosure, an iron-based alloy may include iron, chromium, molybdenum, and niobium. In this case, each constituent element may be included in a predetermined weight ratio to have excellent glass forming ability when a product is manufactured and to have excellent chemical properties such as oxidation resistance and corrosion resistance as well as excellent mechanical properties such as hardness and wear resistance have excellent effects.

According to another aspect of the present disclosure, iron-based alloy powder may have a composition including iron, chromium, molybdenum, and niobium, and may be used for various methods such as additive manufacturing, powder metallurgy, powder injection, or thermal spray coating, and a product manufactured using the iron-based powder may have a composite structure, including both an amorphous phase and ceramic crystal, to have excellent oxidation resistance, wear resistance, and high-temperature characteristics.

In particular, according to an aspect of the present disclosure, iron-based alloy powder may have a significantly low mass increase rate due to oxidation at high temperature, and thus an issue caused by formation of an oxide may not substantially occur during utilization of the alloy powder and oxidation resistance, wear resistance, or the like, at high temperature may be improved.

BRIEF DESCRIPTION OF DRAWINGS

FIG. 1(*a*) and FIG. 1(*b*) are a diagram illustrating results of observing cross-sections of powder particles of Example 3 and Comparative Example 1, and FIG. 2(*a*) and FIG. 2(*b*) are a graph illustrating results of analyzing particle sizes of the powder particles.

FIG. 3(*a*) and FIG. 3(*b*) are is a diagram illustrating results of observing alloy powder particles of Example 3 and Comparative Example 1 through XRD analysis.

FIG. 4(*a*) and FIG. 4(*b*) are is a diagram illustrating results of observing the alloy powder particles of Example 3 and Comparative Example 1 with an electron probe microanalyzer (EPMA).

BEST MODE FOR INVENTION

Prior to describing the present disclosure in detail below, it should be understood that the terms used herein are merely intended to describe specific embodiments and are not to be construed as limiting the scope of the present disclosure, which is defined by the appended claims. Unless otherwise defined, all terms including technical and scientific terms used herein have the same meaning as commonly understood by one of ordinary skill in the art to which the present disclosure belongs.

Hereinafter, examples of the present disclosure and technical effects thereof will be described with reference to accompanying drawings.

An iron-based alloy according to an aspect of the present disclosure may contain iron (Fe), chromium (Cr), molybdenum (Mo), and niobium (Nb). The iron-based alloy according to an aspect of the present disclosure contains iron as a metal constituting an alloy, and thus may be significantly advantageous in terms of rigidity and economic feasibility of the alloy.

Chromiummay be included in the alloy to improve physical or chemical properties such as wear resistance and corrosion resistance of the iron-based alloy.

To secure glass forming ability and wear resistance, chromium may be contained in an amount of 17.22 parts by weight or more, per 100 parts by weight of iron. The chromium may be contained in an amount of, in detail, 18.32 parts by weight or more and, in more detail, 21.96 parts by weight or more. On the other hand, when chromium is excessively contained, an intermetallic compound may be formed to increase brittleness and to reduce corrosion resistance. Accordingly, chromium may be contained in an amount of 58.23 parts by weight or less, per 100 parts by weight of iron. Chromium may be contained in an amount of, in detail, 44.25 parts by weight or less and, in more detail, 34.11 parts by weight or less.

Chromium may be contained in the iron-based alloy in an amount of 14.5 wt % or more and, in detail, 15 wt % or more, in more detail, 17 wt % or more. On the other hand, chromium may be contained in the iron-based alloy in an amount of 29 wt % or less and, in detail, 25 wt % or less, in more detail, 22 wt % or less.

Molybdenum may be added to improve wear resistance, corrosion resistance, and friction resistance of the iron-based alloy.

To achieve such an effect, molybdenum may be contained in an amount of 1.2 parts by weight or more, relatively to 100 parts by weight of iron. Molybdenum may be contained an in an amount of 2.44 parts by weight or more and, in detail, 4.52 parts by weight or more.

On the other hand, when molybdenum is excessively contained, the molybdenum may be diffused and precipitated without being dissolved in a matrix to deteriorate thermal properties of the material. Accordingly, molybdenum may be contained in an amount of 26.10 parts by weight or less, per 100 parts by weight of iron. Molybdenum may be contained in an amount of 19.47 parts by weight or less and, in detail, 12.40 parts by weight or less.

Molybdenum may be contained in the iron-based alloy in an amount of 1 wt % or less and, in detail, 2 wt % or more, in more detail, 3.5 wt % or more. On the other hand, molybdenum may be contained in the iron-based alloy in an amount of 13 wt % or less and, in detail, 11 wt % or less, in more detail, 8 wt % or less.

Niobium is an element dissolved in a matrix structure to significantly improve high-temperature stability of the matrix. Niobium does not react with oxygen in the atmosphere at high temperature, does not react with most chemicals, and does not corrode.

To achieve such an effect, niobium may be contained in an amount of 0.12 parts by weight or more, per 100 parts by weight of iron. Niobium may be contained in an amount of, in detail, 0.61 parts by weight or more, in more detail, 1.29 parts by weight or more.

On the other hand, when niobium is excessively contained, niobium which is not dissolved in the matrix may segregate on an interface of the matrix or form an additional phase, and thus may reduce high-temperature stability and high-temperature oxidation resistance may be reduced. Accordingly, niobium may be contained in an amount of 6.22 parts by weight, per 100 parts by weight of iron. Niobium may be contained in an amount of, in detail, 5.31 parts by weight, in more detail, 3.10 parts by weight or less.

Niobium may be contained in the iron-based alloy in an amount of 0.1 wt % or more and, in detail, 0.5 wt % or more, in more detail, 1 wt % or more. On the other hand, niobium may be contained in the iron-based alloy in an amount of 3.1 wt % or less and, in detail, 3 wt % or less, in more detail, 2 wt % or less. In addition, the iron-based alloy according to an aspect of the present disclosure may further include at least one selected from the group consisting of boron (B), carbon (C), and silicon (Si).

Boron may serve to provide mismatching and effective packing through a difference in particle size from metal atoms in the alloy to improve glass forming ability of the alloy. In addition, boron may form a boride to improve mechanical properties and wear resistance of the material.

To achieve such an effect, boron may be contained in an amount of 0.12 parts by weight or more, per 100 parts by weight of iron. Boron may be contained in an amount of, in detail, 0.61 parts by weight or more, in more detail, 1.29 parts by weight or more.

On the other hand, when boron is excessively contained, a content of elements dissolved in a metal matrix may be reduced by an excessively formed boride to reduce chemical stability and to excessively increase brittleness of the material. Accordingly, boron may be contained in an amount of 6.63 parts by weight or less, per 100 parts by weight of iron. Boron may be contained in an amount of, in detail, 5.31 parts by weight or less, in more detail, 3.88 parts by weight or less.

Boron may be contained in the iron-based alloy in an amount of 0.1 wt % or more and, in detail, 0.5 wt % or more, in more detail, 1 wt % or more. On the other hand, boron may be contained in the iron-based alloy in an amount of 3.3 wt % or less and, in detail, 3 wt % or less, in more detail, 2.5 wt % or less.

Similarly to boron, carbon may serve to provide mismatching and effective packing through a difference in particle size from metal atoms in the alloy to improve glass forming ability of the alloy. In addition, when the amount of added carbon is less than a predetermined amount, carbon may not be uniformly distributed in the matrix, resulting in a local mechanical property deviation of the material. Accordingly, carbon may be contained in an amount of 0.12 parts by weight or more and, in detail, 0.13 parts by weight or more, per 100 parts by weight of iron.

On the other hand, when carbon is excessively contained, carbide may be excessively formed to prevent a solid solution strengthening effect of the matrix from being sufficiently exhibited, so that mechanical properties of the material may be deteriorated. Accordingly, carbon may be contained in an amount of 3.61 parts by weight or less. Carbon may be contained in an amount of, in detail, 2.65 parts by weight or less, in more detail, 1.55 parts by weight or less.

Carbon may be contained in the iron-based alloy in an amount of 0.1 wt % or more. On the other hand, carbon may be included in the iron-based alloy in an amount of 1.8 wt % or less and, in detail, 1.5 wt % or less, in more detail, 1.0 wt % or less.

The iron-based alloy according to an aspect of the present disclosure may include 17.22 to 58.23 parts by weight of chromium, 1.2 to 26.1 parts by weight of molybdenum, 0.12 to 6.22 parts by weight of niobium, and 0.12 to 6.63 parts by weight of boron, per 100 parts by weight of iron. Additionally, the iron-based alloy may include at least one selected from the group consisting of 0.12 to 6.63 parts by weight of boron and 0.12 to 3.61 parts by weight of carbon.

The iron-based alloy may contain, in detail, 18.32 to 44.25 parts by weight of chromium, 2.44 to 19.47 parts by weight of molybdenum, 0.61 to 5.31 parts by weight of niobium, 0.61 to 5.31 parts by weight of boron, and 0.12 to 2.65 parts by weight of carbon, per 100 parts by weight of iron.

In addition, the iron-based alloy may contain, in more detail, 21.96 to 34.11 parts by weight of chromium, 4.52 to 12.40 parts by weight of molybdenum, 1.29 to 3.10 parts by weight of niobium, 1.29 to 3.88 parts by weight of boron, and 0.13 to 1.55 parts by weight of carbon, per 100 parts by weight of iron.

The iron-based alloy according to an aspect of the present disclosure may further contain at least one selected from the group consisting of tungsten (W), cobalt (Co), yttrium (Y), manganese (Mn), aluminum (Al), zirconium (Zr), phosphorus (P), nickel (Ni), and scandium (Sc), other than the above-described alloy components. The at least one component may be contained in a lower content than the above-described iron, chromium, molybdenum, boron, and carbon. On the other hand, the iron-based alloy according to an aspect of the present disclosure may contain a portion of impurities inevitably introduced during a manufacturing process.

Since silicon (Si) is a component disadvantageous in exhibiting glass forming ability and high-temperature oxidation resistance, silicon is not artificially added in the iron-based alloy according to an aspect of the present. Even when silicon is inevitably introduced, a content of the introduced silicon may be strongly suppressed. Silicon may be contained in an amount of 0.2 parts by weight or less per 100 parts by weight of iron. Silicon may be contained in an amount of, in detail, 0.1 parts by weight or less, in more detail, 0.05 parts by weight or less. Silicon may be contained in an amount of, in even more detail, 0 parts by weight. On the other hand, silicon may be contained in an amount of 0.5 times or less, in detail, 0.3 times or less, in more detail, 0.1 times or less, relative to a content of carbon contained in the iron-based alloy.

In the iron-based alloy according to an aspect of the present disclosure, a ratio of the weight of chromium to the weight of molybdenum (Cr/Mo) may satisfy a range of 3 to 5. When the content ratio of chromium and molybdenum satisfies the corresponding range, excellent glass forming ability may be secured, and an advantageous effect of improving chemical and mechanical properties such as oxidation resistance, wear resistance, and hardness may be obtained. The ratio of the weight of chromium to the weight of molybdenum may be, in detail, 3.5 to 4.75, in more detail, 3.75 to 4.25. The iron-based alloy according to an aspect of the present disclosure includes elements according to the above-described composition, and thus may have excellent glass forming ability to form an amorphous phase.

Iron-based alloy powder according to an aspect of the present disclosure may be prepared from the above-described iron-based alloy. The iron-based alloy powder according to an aspect of the present disclosure may have the same composition as the above-described iron-based alloy, but may further include some different compositions introduced by cooling or oxidation when the alloy powder is prepared. The iron-based alloy powder according to an aspect of the present disclosure may include an amorphous phase due to the excellent glass forming ability of a raw material.

The iron-based alloy powder according to one aspect of the present disclosure may be prepared by variously changing particle size and shape depending on use and application methods such as 3D printing, powder metallurgy, injection, molding, or thermal spray coating, and the particle size and shape may not be limited. For example, the iron-based alloy powder may have a particle size distribution of 1 to 150 μm and, in detail, of 10 to 100 μm. Alloy powder used for thermal spray coating may have an average particle size of 10 μm to 54 μm and, in detail, 16 to 43 μm. Alloy powder used for metal injection molding (MIM) may have an average particle size of 20 μm or less and, in detail, 5 to 16 μm.

As alloy powder used for 3D printing, a fine powder having an average particle size of 20 μm or less may be preferentially used in the case of 3D printing of a powder bed fusion method, and coarse powder having an average particle size of 150 to 430 μm and, in detail, 50 to 100 μm may be preferentially used in 3D printing of a direct energy deposit (DED) method. Even in the case of alloy powder used for laser cladding, alloy powder having a size similar to that in the DED method may be used.

When the particle size distribution and average size of the alloy powder are outside of the range, it may be difficult to obtain uniform quality when a product is manufactured using the alloy powder, and operation efficiency may be reduced.

A method of preparing iron-based alloy powder according to an aspect of the present disclosure is not limited, but the iron-based alloy powder may be prepared by a method such as water atomizing or gas atomizing, as a non-limiting example.

An atomizing method may refer to a method of preparing alloy powder by spraying gas or water when a molten metal for a molten alloy falls, to split into small particles, and then rapidly cooling alloy powder in a split droplet state. A person skilled in the art can easily understand and repeatedly implement the atomizing method without adding special technical means.

The iron-based alloy powder according to an aspect of the present disclosure may include an amorphous phase and alpha-iron (α-Fe) having a body-centered cubic (BCC) crystal structure.

The iron-based alloy powder according to an aspect of the present disclosure may include at least one of an iron-based boride and a chromium-based boride.

The iron-based boride and the chromium-based boride may be interpreted as including all of an iron boride, a chromium boride, and a boride of iron and chromium.

Chromium contained in the alloy powder may not be solid-solubilized in an iron matrix, and most of the chromium may be present in the form of a boride. The iron-based alloy powder may include 30 to 90 area % of iron boride and chromium-based boride. The iron-based alloy powder may include, in detail, 35 to 85 area % of iron boride and chromium-based boride, in more detail, 40 to 80 area % of iron boride and chromium-based boride.

A boride of molybdenum or niobium may not be contained in the alloy powder, or may be contained in an undetectable amount even when contained in the alloy powder. Most of the molybdenum or niobium contained in the iron-based alloy powder may be present as a solid solution dissolved in an iron-based matrix.

Since the iron-based alloy powder according to an aspect of the present disclosure is prepared by an iron-based alloy having excellent glass forming ability, an amorphous phase or a metallic glass phase may be observed in at least a partial region of a cross-section of the alloy powder. The presence of an amorphous phase or a metallic glass phase may be confirmed through EBSD or TEM.

Since the iron-based alloy powder according to an aspect of the present disclosure has the above-described composition and includes an amorphous phase in at least a partial region thereof, the iron-based alloy powder may have excellent oxidation resistance. For example, the iron-based alloy powder according to an aspect of the present disclosure may have a low oxidation rate at high temperature, a small total amount of oxidation, and a high critical temperature at which oxidation is rapidly performed.

MODE FOR INVENTION

Hereinafter, the present disclosure will be described in more detail through examples. However, it should be noted that the following examples are only provided to describe the present disclosure, and the scope of the present disclosure is not limited to the following examples.

EXAMPLE

Examples 1 to 7: Preparation of Alloy Powder

Materials were weighed to have a predetermined composition, and then molten to obtain an iron-based alloy. The obtained molten alloy was provided to an atomizer in a gas atmosphere to be atomized, and split molten metal droplets were cooled to prepare alloy powder particles of Examples 1 to 7. Alloy components and powder average diameters of Examples 1 to 7 are listed in Table 1.

Examples 8 to 12: Formation of Alloy Coating Layer Using HVOF Method

Oerlikon Metco Diamond Jet series HVOF gas fuel spray system was used, oxygen and propane gas were used as fuel, and high velocity oxygen fuel (HVOF) was used with a spray distance of 30 cm, and thus alloy coating layers having thicknesses listed in Table 2 were formed. The device and specific conditions used herein will be described below.

DJ Gun HVOF

[Condition] Gun type: Hybrid, Air cap: 2701, LPG flow: 160 SCFH, LPG pressure: 90 PSI, Oxygen flow: 550 SCFH, Oxygen pressure: 150 PSI, Air flow: 900 SCFH, Air pressure: 100 PSI, Nitrogen flow: 28 SCFH, Nitrogen pressure: 150 PSI, Gun speed: 100 m/min, Gun pitch: 3.0 mm, Feeder rate 45 g/min, and Stand-off distance: 250 mm

Comparative Example

Comparative Examples 1 to 5: Preparation of Alloy Powder

A molten iron-based alloy was obtained through weight with a predetermined composition, and was then provided to an atomizer in a nitrogen gas atmosphere to prepare alloy powder particles of Comparative Examples 1 to 5. Alloy components and powder average diameters of Comparative Examples 1 to 5 are listed in Table 1.

Comparative Examples 6 to 10: Formation of Alloy Coating Layer

The alloy powder particles of Comparative Examples 1 to were coated in the same manner as in Examples 8 to 12 to obtain alloy coating layers of Comparative Examples 6 to 10 listed in Table 2.

TABLE 1

| | Alloy Composition | | | | | | | Powder Average | |
|---|---|---|---|---|---|---|---|---|---|
| Classification | Fe (g) | Cr (g) | Mo (g) | Nb (g) | B (g) | C (g) | Si (g) | Diameter (μm) | Cr/Mo |
| Example 1 | 100 | 27.55 | 6.89 | 4.82 | 2.75 | 0.55 | 0 | 33.1 | 4.00 |
| Example 2 | 100 | 28.23 | 7.06 | 2.47 | 2.82 | 0.56 | 0 | 33.1 | 4.00 |
| Example 3 | 100 | 17.22 | 26.10 | 0.12 | 6.63 | 0.12 | 0 | 31.9 | 0.66 |
| Example 4 | 100 | 58.23 | 1.2 | 6.22 | 0.12 | 3.61 | 0 | 34.0 | 48.53 |
| Example 5 | 100 | 21.96 | 4.52 | 1.29 | 3.88 | 0 | 0 | 33.8 | 4.86 |
| Example 6 | 100 | 18.32 | 19.47 | 0.61 | 0 | 2.65 | 0 | 35.0 | 0.94 |
| Example 7 | 100 | 44.25 | 2.44 | 5.31 | 0 | 0 | 0 | 32.8 | 18.14 |

TABLE 1-continued

| Classification | Alloy Composition Fe (g) | Cr (g) | Mo (g) | Nb (g) | B (g) | C (g) | Si (g) | Powder Average Diameter (μm) | Cr/Mo |
|---|---|---|---|---|---|---|---|---|---|
| Comparative Example 1 | 100 | 86.10 | 0 | 0 | 12.24 | 0.25 | 1.40 | 31.2 | — |
| Comparative Example 2 | 100 | 16.49 | 27.74 | 6.78 | 0 | 3.96 | 0 | 32.6 | 0.59 |
| Comparative Example 3 | 100 | 60.52 | 1.0 | 0.1 | 7.71 | 0.1 | 0 | 32.4 | 60.52 |
| Comparative Example 4 | 100 | 27.55 | 6.89 | 0.08 | 2.75 | 0.55 | 0 | 33.1 | 4.00 |
| Comparative Example 1 | 100 | 28.23 | 7.06 | 7.02 | 2.82 | 0.56 | 0 | 33.1 | 4.00 |

TABLE 2

| Classification | Coating Method | Thickness of Coating layer (μm) | Alloy Powder Used |
|---|---|---|---|
| Example 8 | HVOF | 215.0 | Example 1 |
| Example 9 | HVOF | 425.1 | Example 2 |
| Example 10 | HVOF | 228.2 | Example 5 |
| Example 11 | HVOF | 388.3 | Example 6 |
| Example 12 | HVOF | 320.1 | Example 7 |
| Comparative Example 6 | HVOF | 223.3 | Comparative Example 1 |
| Comparative Example 7 | HVOF | 278.0 | Comparative Example 2 |
| Comparative Example 8 | HVOF | 401.7 | Comparative Example 3 |
| Comparative Example 9 | HVOF | 232.5 | Comparative Example 4 |
| Comparative Example 10 | HVOF | 257.4 | Comparative Example 5 |

Experimental Example

Experimental Example 1: Analysis of Particle Size of Alloy Powder

Particle sizes of the alloy powder particles of Example 3 and Comparative Example 1 were analyzed, and cross-sections of the powder particles were observed with an electron microscope (SEM). FIG. 1 is a diagram illustrating results of observing the cross-sections of the powder particles of Example 3 and Comparative Example 1, and FIG. 2 is a graph illustrating results of analyzing the particle sizes of the powder particles.

In (a) of FIG. 1 and (a) of FIG. 2, it can be seen that the alloy powder of Example 3 is a spherical powder particle having a particle size distribution of 11.2 to 81.1. In (b) of FIG. 1 and (b) of FIG. 2, it can be seen that the alloy powder of Comparative Example 1 is a spherical powder particle having a particle size distribution of 11.2 to 81.2.

Experimental Example 2: XRD Crystal Analysis of Alloy Powder

The alloy powder particles of Example 3 and Comparative Example 1 were observed by XRD analysis, and results thereof are illustrated in FIG. 3.

In Example 3 and Comparative Example 1, Fe, Cr, and Fe-based boride having a body-centered cubic (bcc) structure were commonly detected.

Experimental Example 3: Observation of Microstructure of Alloy Powder

The alloy powder particles of Example 3 and Comparative Example 1 were observed with an electron probe microanalyzer (EPMA) analyzer to obtain the same results as illustrated in FIG. 4.

It can be seen that, in both Example 3 and Comparative Example 1, alpha-iron (α-Fe(BCC)), a Cr matrix, and Cr-based boride phases are all present in spherical powder particles.

Experimental Example 4: Estimation of Oxidation Characteristics of Alloy Powder After 50 g of the alloy powder particles of Examples 1 to 7 and Comparative Examples 1 to 5 were put into an $Al_2O_3$ pot, weight variation when a temperature was increased was observed using TG-DTA 8122 manufactured by Rigaku Corporation. A heating rate was set to be 10° C./min, a stop temperature was set to be 120° C., and variations of mass of the powder particles were observed while heating the powder particles from room temperature to 1200° C. A weight of each powder at the room temperature and a weight of each powder at 1200° C. were measured and listed in Table 3, and a weight gained at 1200° C., relative to a weight at the room temperature, was converted into a weight gain (%) and is also listed in Table 3. In addition, a temperature at a point at which oxidation is rapidly increased to rapidly increase a weight of powder (a weight gain conversion temperature, ° C.) was measured and is also listed in Table 3.

TABLE 3

| Classification | Weight at Room Temperature (mg) | Weight at 1200° C. (mg) | Weight Gain (%) | Weight Gain Conversion Temperature (° C.) |
|---|---|---|---|---|
| Example 1 | 50130 | 50135 | 0.010 | 1009 |
| Example 2 | 50210 | 50211 | 0.002 | 1075 |
| Example 3 | 50118 | 50466 | 0.694 | 1025 |
| Example 4 | 50214 | 50666 | 0.900 | 1013 |
| Example 5 | 50105 | 50120 | 0.030 | 1053 |
| Example 6 | 50266 | 50691 | 0.846 | 1025 |
| Example 7 | 50420 | 51007 | 1.164 | 1080 |
| Comparative Example 1 | 50110 | 50896 | 1.569 | 970 |
| Comparative Example 2 | 50124 | 50983 | 1.714 | 992 |

TABLE 3-continued

| Classification | Weight at Room Temperature (mg) | Weight at 1200° C. (mg) | Weight Gain (%) | Weight Gain Conversion Temperature (° C.) |
|---|---|---|---|---|
| Comparative Example 3 | 50235 | 51045 | 1.612 | 981 |
| Comparative Example 4 | 50148 | 51362 | 2.421 | 982 |
| Comparative Example 5 | 50325 | 52678 | 4.676 | 964 |

Experimental Example 5: Estimation of Wear Resistance of Alloy Coating Layer

Wear resistance characteristics of the alloy coating layers of Examples 8 to 12 and Comparative Examples 6 to 10 were estimated. The degree of wear was measured using a pin on disc wear test machine (RB-102PD) by rubbing the coating layers with $Si_3N_4$ at a load of 5 kgf and a rate of 0.05 m/s at room temperature, and results thereof are listed in Table 4.

TABLE 4

| Classification | Amount of Wear ($mm^3$) | Ratio of Amorphous Phase (%) |
|---|---|---|
| Example 8 | 0.150 | 10.3 |
| Example 9 | 0.016 | 13.5 |
| Example 10 | 0.210 | 9.7 |
| Example 11 | 0.170 | 8.40 |
| Example 12 | 0.220 | 7.90 |
| Comparative Example 6 | 3.255 | 0 |
| Comparative Example 7 | 4.240 | 0 |
| Comparative Example 8 | 2.980 | 0 |
| Comparative Example 9 | 0.210 | 9.7 |
| Comparative Example 10 | 0.097 | 8.4 |

Experimental Example 6: Measurement of Amorphous Ratio of Alloy Coating Layer

Crystals of the alloy coating layers of Examples 8 to 12 and Comparative Examples 6 to 10 were analyzed by an electron backscatter diffraction (EBSD) method using a back scattering electron diffraction pattern analyzer (nordlys CMOS detector, step size: 0.05 μm).

As a result of the EBSD analysis, (Cr, Fe)2B and Fe(BCC) phases were commonly observed and a specific amorphous phase ratio of each specimen is listed in Table 4.

As can be seen from Tables 3 and 4, in the examples satisfying the alloy composition of the present disclosure, a weight gain at 1200° C. is 1.5% or less and a weight gain conversion temperature is 1000° C. or more, whereas in the comparative examples which do not satisfy the alloy composition of the present disclosure, a weight gain at 1200° C. is more than 1.5% and a weight gain conversion temperature is less than 1000° C. As also can be seen from Tables 3 and 4, in the examples satisfying the alloy composition of the present disclosure, a ratio of the amorphous phase in the coating layer is greater than 7 area % and an amount of wear of the coating layer is 1.0 $mm^3$ or less, whereas in the comparative examples which do not satisfy the alloy composition of the present disclosure, a ratio of the amorphous phase in the coating layer is less than 7 area % and an amount of wear of the coating layer is greater than 1.0 $mm^3$. That is, it can be seen that the examples satisfying the alloy composition of the present disclosure have not only excellent high-temperature oxidation resistance but also excellent glass forming ability, whereas the comparative examples which do not satisfy the alloy composition of the present disclosure have relatively poor high-temperature oxidation resistance or relatively poor glass forming ability.

While example embodiments have been shown and described above, it will be apparent to those skilled in the art that modifications and variations could be made without departing from the scope of the present disclosure as defined by the appended claims.

The invention claimed is:

1. An iron-based alloy comprising:
per 100 parts by weight of iron (Fe),
30 to 58.23 parts by weight of chromium (Cr);
1.20 to 26.10 parts by weight of molybdenum (Mo);
0.12 to 6.22 parts by weight of niobium (Nb);
0.12 to 6.63 parts by weight of boron (B);
0.12 to 3.61 parts by weight of carbon (C); and
unavoidable impurities,
wherein a weight ratio of chromium to molybdenum (Cr/Mo) is from 3 to 5,
wherein the iron-based alloy further includes alpha-iron (α-Fe) having an amorphous phase and a body-centered cubic (BCC) crystal structure,
wherein the iron-based alloy is formed into a powder, and
wherein the powder exhibits a weight gain ratio of 1.5% or less when heated from room temperature to 1200° C.

2. An iron-based alloy powder comprising:
per 100 parts by weight of iron (Fe),
30 to 58.23 parts by weight of chromium (Cr);
1.20 to 26.10 parts by weight of molybdenum (Mo);
0.12 to 6.22 parts by weight of niobium (Nb);
0.12 to 6.63 parts by weight of boron (B);
0.12 to 3.61 parts by weight of carbon (C); and
unavoidable impurities,
wherein a weight ratio of chromium to molybdenum (Cr/Mo) is from 3 to 5,
wherein the iron-based alloy further includes alpha-iron (α-Fe) having an amorphous phase and a body-centered cubic (BCC) crystal structure,
wherein the powder exhibits a weight gain ratio of 1.5% or less when heated from room temperature to 1200° C., and
wherein the powder comprises an amorphous phase.

3. The iron-based alloy powder of claim 2, wherein an average particle diameter of the iron-based alloy powder is 10 μm to 54 μm.

4. The iron-based alloy powder of claim 2, which is used for high-velocity oxygen fuel (HVOF) spray coating or plasma spray coating.

5. An iron-based alloy powder comprising:
per 100 parts by weight of iron (Fe),
30 to 58.23 parts by weight of chromium (Cr);
1.20 to 26.10 parts by weight of molybdenum (Mo);
0.12 to 6.22 parts by weight of niobium (Nb);
0.12 to 6.63 parts by weight of boron (B);
0.12 to 3.61 parts by weight of carbon (C);
either or both of (i) 40 to 80 area % of an iron-based boride or a chromium-based boride, and (ii) a solid solution formed by dissolving the molybdenum or the niobium with the iron; and
unavoidable impurities,
wherein a weight ratio of chromium to molybdenum (Cr/Mo) is from 3 to 5, wherein the iron-based alloy further includes alpha-iron ($\alpha$-Fe) having an amorphous phase and a body-centered cubic (BCC) crystal structure, wherein the powder exhibits a weight gain ratio of 1.5% or less when heated from room temperature to 1200° C., and wherein the powder comprises an amorphous phase.

* * * * *